US011809138B2

(12) United States Patent
Saglini et al.

(10) Patent No.: US 11,809,138 B2
(45) Date of Patent: Nov. 7, 2023

(54) BALANCE CLEARANCE ADJUSTMENT FIXING DEVICE

(71) Applicant: ETA SA Manufacture Horlogère Suisse, Grenchen (CH)

(72) Inventors: Julien Saglini, Bienne (CH); Raphaël Courvoisier, Corcelles (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 76 days.

(21) Appl. No.: 17/476,994

(22) Filed: Sep. 16, 2021

(65) Prior Publication Data

US 2022/0171338 A1 Jun. 2, 2022

(30) Foreign Application Priority Data

Nov. 27, 2020 (EP) ..... 20210242

(51) Int. Cl.
*G04B 18/06* (2006.01)
*G04B 18/02* (2006.01)

(52) U.S. Cl.
CPC ..... *G04B 18/06* (2013.01); *G04B 18/02* (2013.01); *G04B 18/026* (2013.01)

(58) Field of Classification Search
CPC ..... G04B 18/02; G04B 18/026; G04B 18/06
See application file for complete search history.

(56) References Cited

U.S. PATENT DOCUMENTS 3,483,693 A * 12/1969 Smythe, Jr. ..... G04B 35/00 968/293
2006/0062088 A1* 3/2006 Hintze ..... G04B 18/023 368/175
2007/0147180 A1* 6/2007 Rufenacht ..... G04B 31/00 368/184
2007/0159931 A1 7/2007 Rufenacht et al.
2011/0051565 A1* 3/2011 Schmiedchen ..... G04B 17/325 368/173
2012/0082010 A1* 4/2012 Boulenguiez ..... G04B 17/325 368/184
2014/0328150 A1* 11/2014 Boulenguiez ..... G04B 17/26 29/896.31

(Continued)

FOREIGN PATENT DOCUMENTS

CH 273136 A 1/1951
JP 2007-178431 A 7/2007

OTHER PUBLICATIONS

Japanese Office Action dated Sep. 20, 2022 in Japanese Patent Application No. 2021-147472 (with English translation), 6 pages.

(Continued)

*Primary Examiner* — Edwin A. Leon
*Assistant Examiner* — Sean R Brannon
(74) *Attorney, Agent, or Firm* — Oblon, McClelland, Maier & Neustadt, L.L.P.

(57) ABSTRACT

A fixing device for adjusting the clearance of a balance. At least one fixing device including at least one stud holder, at least one bearing body, at least one support member and at least one holding member. At least one bearing body is configured to move relative to at least one stud holder so as to fix the adjustment of the clearance of the balance and at least one support member is configured to press at least one bearing body against at least one stud holder before being held by at least one holding member.

4 Claims, 1 Drawing Sheet

(56) References Cited

U.S. PATENT DOCUMENTS

| | | | | |
|---|---|---|---|---|
| 2014/0341001 | A1* | 11/2014 | Cordier | G04B 17/325<br>368/131 |
| 2015/0177689 | A1* | 6/2015 | Capt | G04B 15/14<br>368/178 |
| 2019/0064739 | A1* | 2/2019 | Christan | G04B 17/063 |

OTHER PUBLICATIONS

European Search Report dated Apr. 21, 2021 in European Application 20210242.2, filed on Nov. 27, 2020 (with English Translation of Categories ofcited documents), 3 pages.

* cited by examiner

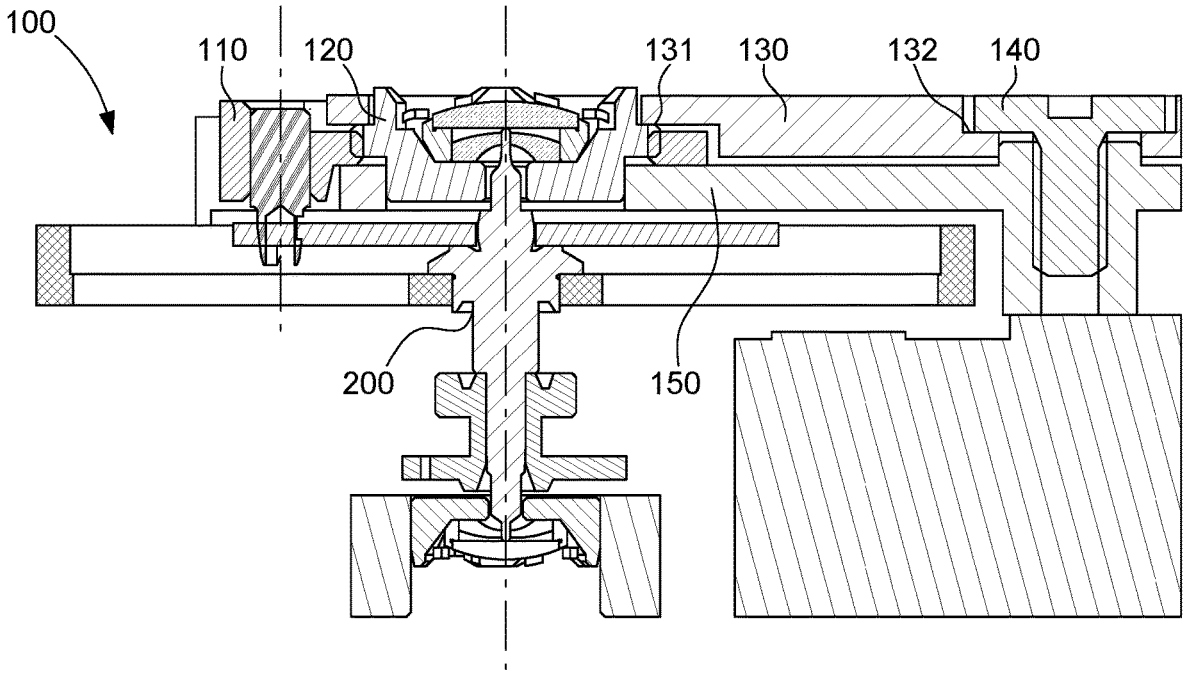
100
110
120
131
130
132
140
200
150

BALANCE CLEARANCE ADJUSTMENT FIXING DEVICE

CROSS-REFERENCE TO RELATED APPLICATION

This application claims priority to European Patent Application No. 20210242.2 filed on Nov. 27, 2020, the entire disclosure of which is hereby incorporated herein by reference.

TECHNICAL FIELD OF THE INVENTION

The present invention relates to the field of watchmaking. It relates more particularly to fixing devices for adjusting the balance clearance.

TECHNOLOGICAL BACKGROUND

The adjustment of the balance clearance is essential for the proper operation of a mechanical movement. Equally important is the positioning and locking of the stud holder and the balance shock-absorber. In most mechanical movements, the shock-absorber is driven into the balance bridge, itself locking the stud holder.

To adjust these two elements, it is necessary to exert a significant force on these elements which is tedious and can cause degradation of said elements and their environment.

SUMMARY OF THE INVENTION

The present invention relates to a fixing device for adjusting the clearance of a balance, preferably for adjusting the clearance of said balance; said at least one fixing device comprising at least one stud holder, at least one:

- bearing body; said at least one bearing body being configured to move relative to said at least one stud holder;
- support member; said at least one support member being configured to press said at least one bearing body against said at least one stud holder; and,
- holding member; said at least one holding member being configured to hold said at least one support member pressed against said at least one bearing body so as to fix the adjustment of said clearance of said balance.

Thanks to this arrangement, said fixing device allows to adjust said at least one stud holder and the positioning of said at least one bearing body without having to exert significant forces, and allows to guarantee the functionality of the movement and a good resistance during shocks.

According to one embodiment, said fixing device comprises at least one balance bridge configured to cooperate with said at least one holding member.

Thanks to this arrangement, said at least one holding member can cooperate with said at least one balance bridge.

According to one embodiment, said at least one bearing body is configured to be comprised between said at least one stud holder and said at least one support member.

Thanks to this arrangement, the adjustment of said at least one bearing body is maintained thanks to said at least one stud holder and said at least one support member.

According to one embodiment, said at least one support member comprises a first support surface configured to press said at least one bearing body against said at least one stud holder and at least one second support surface configured to be in contact with said at least one holding member.

Thanks to this arrangement, said at least one support member transmits the force of said at least one holding member to said at least one bearing body.

According to one embodiment, said at least one bearing body comprises a tapping or a thread disposed on the outer periphery of said at least one bearing body and said at least one stud holder comprises a thread or a tapping disposed on the inner periphery of said at least one stud holder.

Thanks to this arrangement, said at least one bearing body can be screwed to said at least one stud holder.

BRIEF DESCRIPTION OF THE FIGURES

The invention will be described in more detail below using the appended drawing, given by way of non-limiting example, wherein FIG. 1 represents a balance clearance adjustment fixing device.

DETAILED DESCRIPTION OF THE INVENTION

The adjustment of the balance clearance is essential for the proper operation of a mechanical movement. To this end, the applicant proposes a fixing device 100 for adjusting the clearance of a balance 200. Said at least one fixing device 100 comprising at least one stud holder 110, at least one bearing body 120, at least one support member 130 and at least one holding member 140.

As shown in FIG. 1, said at least one bearing body 120 is configured to move relative to said at least one stud holder 110 through a thread-tapping.

Indeed, according to the embodiments, said at least one bearing body 120 may comprise a tapping or a thread disposed on the outer periphery of said at least one bearing body 120. Said at least one stud holder 110, in turn, may comprise a thread or a tapping disposed on the inner periphery of said at least one stud holder 110 so that said at least one bearing body 120 can be screwed to said at least one stud holder 110 and thus adjust the clearance of said balance 200.

Said at least one support member 130 is configured to press said at least one bearing body 120 against said at least one stud holder 110 and said at least one holding member 140 allows to hold said at least one support member 130 pressed against said at least one bearing body 120 so as to fix the adjustment of said clearance of said balance 200 and therefore the positioning of said at least one bearing body 120 without having to exert significant forces while ensuring the functionality of the movement and good resistance during shocks. In other words, said at least one bearing body 120 may be comprised between said at least one stud holder 110 and said at least one support member 130 so as to be held by means of said at least one stud holder 110 and said at least one support member 130.

This hold can be improved by means of support surfaces present on said at least one support member 130. Indeed, said at least one support member 130 comprises a first support surface 131 allowing to press said at least one bearing body 120 against said at least one stud holder 110 and at least one second support surface 132 transmitting the holding force exerted by said at least one holding member 140 to said at least one bearing body 120.

The whole, that is to say said at least one stud holder 110, said at least one bearing body 120, said at least one support member 130 and said at least one holding member 140, rests on at least one balance bridge 150 configured to cooperate with said at least one holding member 140.

The invention claimed is:

1. A fixing device for adjusting a clearance of a balance, said fixing device comprising:

a stud holder;

a bearing body configured to move relative to said stud holder;

a support member configured to press said bearing body against said stud holder; and a holding member configured to hold said support member pressed against said bearing body so as to fix the adjustment of said clearance of said balance, wherein said bearing body comprises a tapping or a thread disposed on an outer periphery of said bearing body and said stud holder comprises a thread or a tapping disposed on an inner periphery of said stud holder.

2. The fixing device according to claim 1, which comprises a balance bridge configured to cooperate with said holding member.

3. The fixing device according to claim 1, wherein said bearing body is configured to be comprised between said stud holder and said support member.

4. The fixing device according to claim 1, wherein said support member comprises a first support surface configured to press said bearing body against said stud holder and a second support surface configured to be in contact with said holding member.

* * * * *